United States Patent [19]

Spencer

[11] 4,167,281

[45] Sep. 11, 1979

[54] GATE LATCH

[75] Inventor: Donald B. Spencer, Cincinnati, Ohio

[73] Assignee: The Mason Fence Company, Leesburg, Ohio

[21] Appl. No.: 841,812

[22] Filed: Oct. 13, 1977

[51] Int. Cl.[2] ..... E05C 3/26

[52] U.S. Cl. ..... 292/216; 292/210

[58] Field of Search ..... 292/153, 154, 213, 216, 292/148, 162, 210

[56] References Cited

U.S. PATENT DOCUMENTS

| | | | |
|---|---|---|---|
| 54,162 | 4/1866 | Hoffman | 292/153 |
| 853,764 | 5/1907 | Brown | 292/175 |
| 861,406 | 7/1907 | Stetler | 292/216 |
| 1,241,671 | 10/1917 | Smith | 292/216 |
| 2,733,951 | 2/1956 | Heil | 292/162 X |
| 3,151,898 | 10/1964 | Olander | 292/DIG. 32 |
| 3,988,031 | 10/1976 | Meyer | 292/153 |

*Primary Examiner*—Richard E. Moore

*Attorney, Agent, or Firm*—John G. Schenk

[57] ABSTRACT

The bolt of a latching mechanism is spring actuated toward a latching position relative to the latch-receptive slot of a latch-catch which is pivotally mounted on the vertical member of a swing gate, and movement of the bolt from a fully latched position to a retracted non-latching position is controlled by a pendulum stop which is normally and gravitationally disposed in interfering relationship with the bolt, whereby an intentional, deliberate, pendulum-stop-displacing action is required on the part of an attendant in order to enable the bolt to be shifted from an advanced, locked position to a retracted position.

20 Claims, 8 Drawing Figures

GATE LATCH

BACKGROUND OF THE INVENTION

1. Field of the Invention

The field of the invention relates to gate latches and in particular to gate latches of the type which include a bolt which is normally and yieldably urged in a horizontal direction toward an advanced, locking relationship with respect to a pivotally mounted latch-catch.

2. Description of the Prior Art

U.S. Pat. No. 1,352,762 to A. J. Schultze, discloses a gate latch which includes a keeper 4 secured to the door frame, and a latch member 7 which is pivotally mounted to the gate in order that the U-shaped keeper 20 will move in a horizontal plane as keeper 4 is introduced into and withdrawn from the keeper as the gate is closed and opened. The rear portion of the latch member is provided with a pair of notches which are adapted to receive the forward end of a pivotally mounted bolt 8 which is adapted to selectively engage one or the other of the notches of the latch member. Locking means are also provided for controlling the operation of the device.

U.S. Pat. No. 1,538,056 to J. B. Olson discloses a gate latch which comprises a gate engaging member 9 which is pivotally mounted to a vertical, fixed, gate post 2, said member including an outwardly extending forked shaped member 11 between the arms of which the upright member 3 of a gate is received as the gate is swung to a closed position. Pivotally mounted pawls 14 are adapted to selectively engage lugs 12 of member 9 when the gate is closed for precluding accidental or unintentional opening of the gate. The pawls are adapted to engage stops 13 of the gate engaging member 9 when the gate is open to determine the maximum amount by which said member is turned as the gate is opened. Suitable pawl actuating means are also disclosed.

U.S. Pat. No. 1,620,134 of F. Schley discloses gate latching means which comprise forks 28 having outwardly turned ends 28 and 29 adapted to receive the outer vertical frame member 18 of a swing-gate, said forks being secured to and carried by a vertically disposed latching bar which is mounted for vertical endwise and rotary movement between locked and unlocked positions.

U.S. Pat. No. 2,510,520 to F. L. Remmele discloses a gate lock which comprises a fork 38 which is pivoted about a vertical axis for horizontal swinging movement relative to the free end of a swinging or hinged gate or door. A spring-actuated latch 30 is pivoted on a horizontal axis for vertical swinging movement into and out of engagement with laterally spaced slots 47 in fork 38. The pivotally mounted fork and latch 30 are secured to and carried by a fixed fence post or door jam 11.

U.S. Pat. No. 2,577,930 to S. E. Thomas discloses a gate latch which is pivotally secured to and carried by vertical post 12 to engage with the vertical post 15 of the free outer edge of a swing gate 10. A bifurcated latch member is pivotally secured to vertical post 12 whereby to selectively engage and be moved by the vertical post 15 of the swinging gate. The latch member includes a vertical slot 23 which is adapted to loosely receive the up-standing locking arm 19 of a stationary member 18 which is fixedly secured to the vertical member 12 of the fence post. Whenever the latch member is in a lowered position during which the locking arm 19 is disposed within opening 23 rotation of the latch member 17 about vertical member 12 of the fence post is effectively prevented.

U.S. Pat. No. 2,666,660 to B. Youngworth, discloses a gate latch which includes a U-shaped yoke 40 which is pivotally mounted about a vertical axis and which is likewise pivotally mounted about a horizontal axis for movement between engaging and non-engaging positions relative to the vertical member 26 of a pivotally mounted gate. The yoke 40 is secured to and carried by upper section 31 which is fastened to vertical member 25 of a fence post, and a lower member 10 is also secured to and carried by vertical member 25. The adjacent surfaces of the upper and lower members 30 and 10, respectively, are provided with inter-locking surfaces, which, when interlocked and secured against relative end-wise motion effectively maintains yoke 40 in locking engagement with vertical member 26 of the gate.

U.S. Pat. No. 3,697,106 to I. W. Meyer, discloses a gate latch which comprises a latching member 11 which is secured to and carried by a gate, and a triangular shaped keeper 12 which is secured to and carried by a fixed gate-receptive frame. A bolt is yieldably urged to a forward, keeper-engaging position, said bolt having a centrally disposed actuator handle 31.

U.S. Pat. No. 3,774,947 to A. W. Duncan, discloses a gate latch which, the abstract states is "mountable for rocking and axially sliding movement on the end bar of gate frame or on a fence post. A pin extends from opposite sides of the bar or post and the latch is provided with an internal recess having oppositely positioned pockets. The pin extensions are received in said recess for movement therein. When the pin extensions are disposed in the pockets, the latch is in locked position preventing opening of the gate. Upon moving the latch upwardly, the pockets are caused to clear the pin extension so that the latch may be rocked clockwise or counterclockwise to open the gate. A key operated locking element is provided to lock the latch against unauthorized operation."

U.S. Pat. No. 3,877,738 to R. L. Nelson discloses a handle-latch for a swing gate, said handle latch being secured to the vertical member of a gatepost for both endwise and rotary movement thereon. The latch includes a forwardly projecting throat dimensioned to receive the vertical member of a swing gate. When in a lowered position a bolt which depends from the handle latch is received within a bolt receiving member 21 fixedly secured to the same vertical member on which the handle latch is mounted, for thereby precluding rotary motion of the handle latch, and when a pin or padlock is associated with an opening in the bolt, where in its fully lowered position, the handle latch is also prevented from endwise movement.

U.S. Pat. No. 3,918,753 to D. H. McCormack et al, discloses an automatic gate latch which comprises a latch body 10 which is secured to and carried by the vertical gate post 50 of a swing gate, whereby to selectively engage vertical fence post 46 during those periods of time when the gate is closed. The latch body includes a latch yoke 12 pivotally secured to the latch body 10 for movement between engaging and non-engaging positions relative to fence post 46. A spring-actuated vertically disposed latch pin 20 is adapted to selectively engage one or the other of a pair of openings 38 of the latch body when said openings are in alignment with openings 18 of the yoke, the tapered end 22 of latch pin 20 is resiliently urged upwardly against the lower surface of the latch yoke 12 and whenever the latch yoke is disposed in a "locked" position, end 22 of the latch pin will be automatically urged upwardly into and through bore 18 of the latch member. The application of a downward force to lock rod 24 via handle 26 effects a withdrawal of pin 20 from an opening in the latch yoke, permitting the gate to be opened.

The aforesaid references are the most pertinent examples of relevant prior art as presently known to applicant.

DESCRIPTION OF THE PREFERRED EMBODIMENTS

Figure 1:
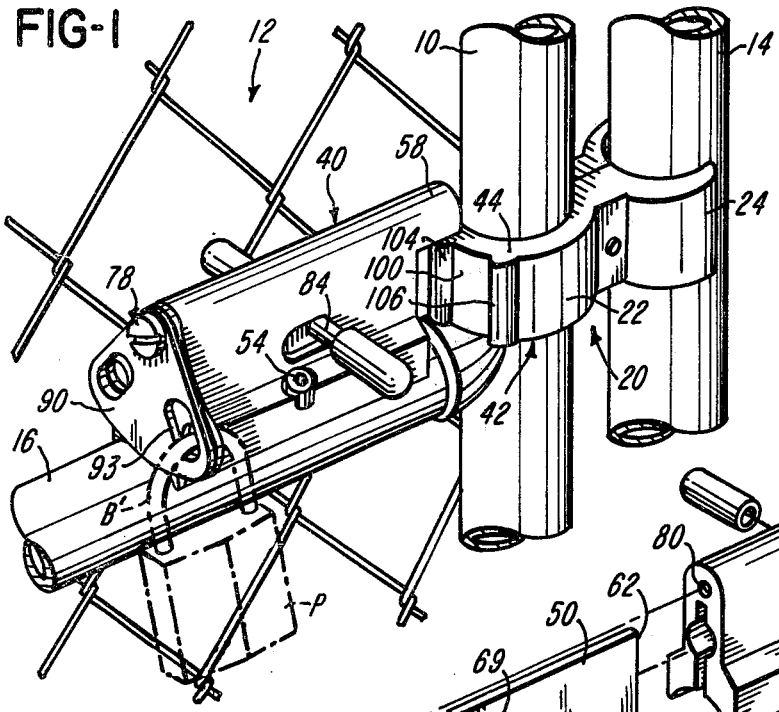
FIG. 1 is a perspective view of the gate latch mechanism of the present invention in a locked position.

In the drawings the numeral 10 denotes the vertical member of and which defines the outermost swinging edge of a gate 12 which is adapted to be swung between closed and open positions relative to the vertical member 14 of a fixed gate frame.

Gate 12 includes a horizontal member 16 intermediate the upper and lower portions of the gate, wherein one end of member 16 is securely anchored to vertical member 10.

A latch-catch denoted generally by the numeral 20 includes a rear portion 22 which is rotatably secured to vertical member 10 of the gate and a forward portion 24 which terminates in an outwardly open U-shaped throat 26 which is adapted to engage vertical member 14 of the gate frame, as illustrated in FIGS. 1, 4, 5 and 6.

Uniformly satisfactory results have been obtained in those instances in which the latch-catch comprises a pair of mating parts A and B (FIG. 8) which are adapted to be securely though releasably interconnected by means of fastener F. Portion A is preferably provided with a recessed area 21 which is adapted to receive a projecting area 23 of part B when portions A and B have been interconnected, as in FIGS. 6 and 7, the rear portion 22 is provided with an elongate bolt-receptive slot or opening 30 which is disposed on a line x—x which passes through the centers of interconnected portions 22 and 24.

Figure 6:
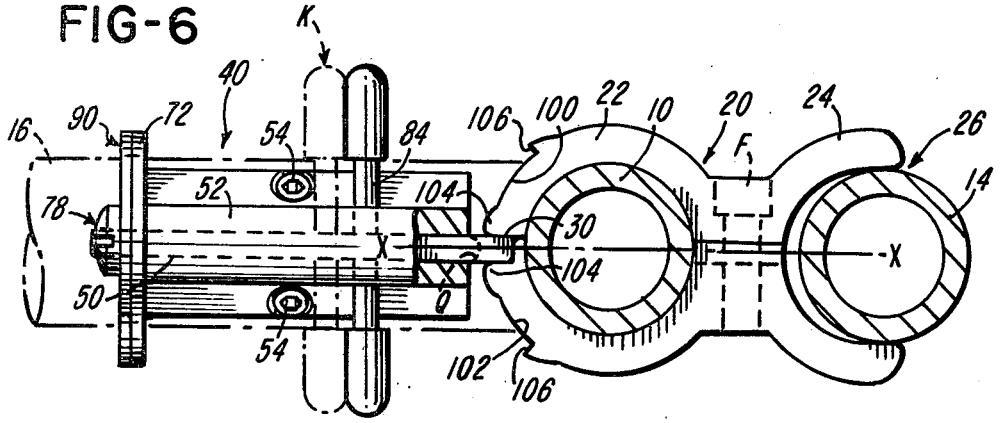
FIG. 6 is a top plan view, partly in section, of the latch mechanism in lock position.
Figure 7:
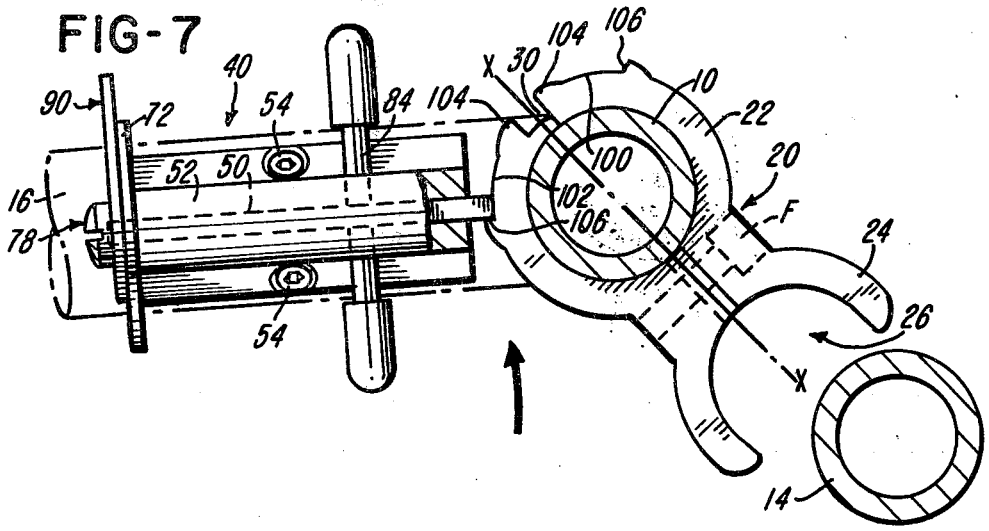
FIG. 7 is a view similar to FIG. 6 illustrating the relationship of the parts in unlocked position.
Figure 8:
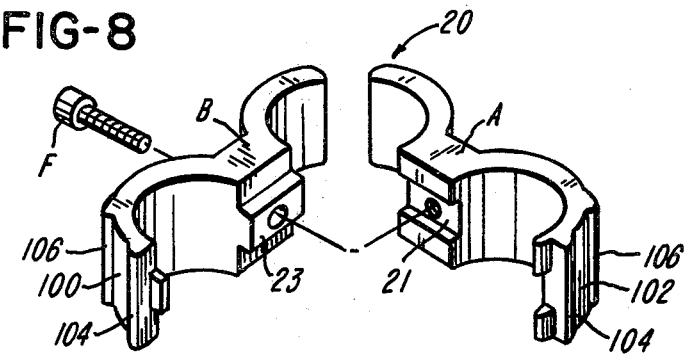
FIG. 8 is an exploded perspective view of the latch-catch.

It will be understood that as the gate is swung from the closed position of FIGS. 1 and 6 in a direction away from vertical member 14 of the gate frame, the latch-catch will be rotated or turned on and about vertical member 10 of the gate as throat 26 is disengaged from vertical member 14 of the gate frame, as illustrated in FIG. 7.

Figure 4:
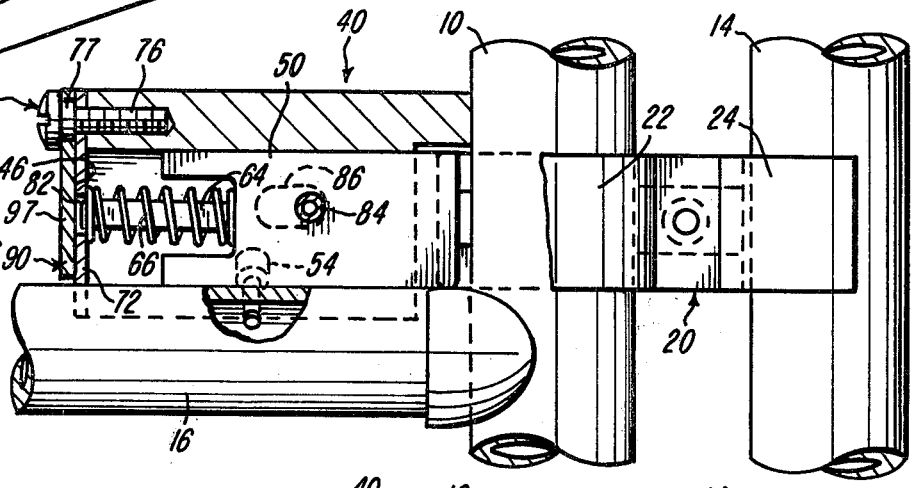
FIG. 4 is a side elevational view, partially in section, of the latch mechanism in locked position.

Means in the form of a bolt mechanism 40 are provided for securely though releasably locking the latch-catch against accidental or unintentional movement from the locked position of FIGS. 1, 4 and 6 to an unlocked position of FIG. 7.

The bolt mechanism comrises a bolt 50 mounted for end-wise movement within a bolt housing 52 which is secured to the horizontal member 16 of the gate by means of fasteners 54 which extend through openings 56 of the bolt housing thence into or through said horizontal member.

As best illustrated in FIG. 1, portions of the lower surface 42 of the rear portion 22 of the latch-catch engage and are supported by and on horizontal gate member 16. The forward end of the bolt housing is provided with a forwardly projecting portion 58 having an under surface 60, which is adapted to loosely over-lie portions of the upper surface 44 of the rear portion of the latch-catch for thereby rotatably positioning the latch-catch on and relative to vertical member 10 of the gate.

Bolt 50 includes a forward end 62 and a rear end 64, said bolt being normally and yieldably urged forwardly, that is, toward the latch-catch by means of a spring 66, forward end 67 of which is adapted to engage portions 69 of the bolt. The rear end 70 of the spring is adapted to abuttingly engage the forward surface of a hasp 72 which includes an opening 74 for the reception of shank 76 of a shoulder bolt 78, shank 76 of which is received within the internally threaded opening 80 of the bolt housing 52. Hasp 72 includes a central opening 82 through which the rear end 64 of the bolt projects. A pin 84 projects through elongate openings 86 provided in the depending side walls of the bolt housing 52 and opening 88 of the bolt, for thereby limiting the overall travel with the bolt between its fully advanced and fully retracted positions.

A pendulum stop 90 is pivotally suspended from opening 92 which engages shoulder 77 of the shoulder bolt 78, whereby to mount said pendulum stop for free gravitational movement about shoulder 77.

Hasp 72 is provided with a pair of through-openings 83 and 85 which are adapted to be selectively disposed in or out of alignment with elongate openings 93 and 95, respectively, of the pendulum stop.

It will be understood that hasp 72 is securely though releasably anchored relative to the rear end of the bolt housing 52 for maintaining spring 66 in place, wherein the said spring exerts a resilient, advancing force to the bolt.

Those portions of the pendulum stop intermediate openings 93 and 95 define a solid abutment area 97, which, when the pendulum stop is in the position illustrated in FIGS. 1 and 4, is disposed in interfering relationship with rear end 64 of the bolt, whereby movement of the bolt toward a retracted position is effectively resisted.

With particular reference to FIG. 6, it will be noted that the forward end of the bolt is adapted to be received and thereafter yieldably maintained within the bolt-receptive slot 30 in the rear portion 22 of the latch-catch 20 during those periods of time, and whenever vertical member 14 of the fixed gate frame is fully engaged by and within open throat 26 of the latch-catch.

When the forward end 62 of bolt 50 has been fully received within slot 30 of the latch-catch, the rear end 64 of the bolt is located entirely on one side of, that is, to the right of, in FIGS. 4 and 6, of the rear surface 46 of the solid abutment area 97 of the pendulum stop, said stop effectively and positively precluding the accidental and/or unintentional movement of bolt 50 from its fully advanced to a retracted position.

Figure 2:
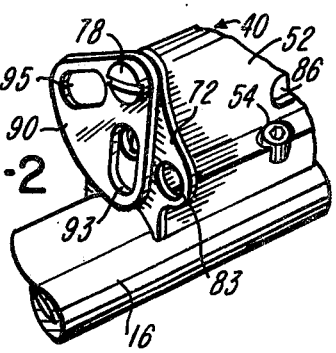
FIG. 2 is a perspective view of the rear portion of the bolt mechanism of the latch mechanism of FIG. 1 illustrating the pendulum stop in bolt-unlocking position.
Figure 3:
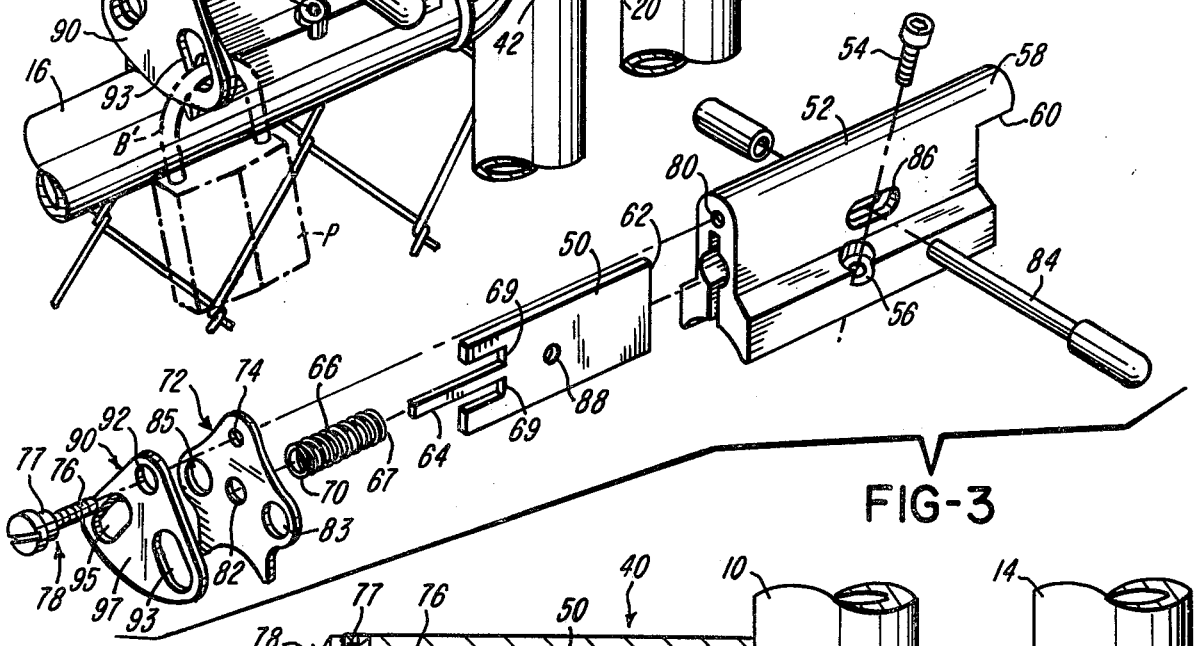
FIG. 3 is a perspective view of the parts of the bolt mechanism in exploded relationship.
Figure 5:
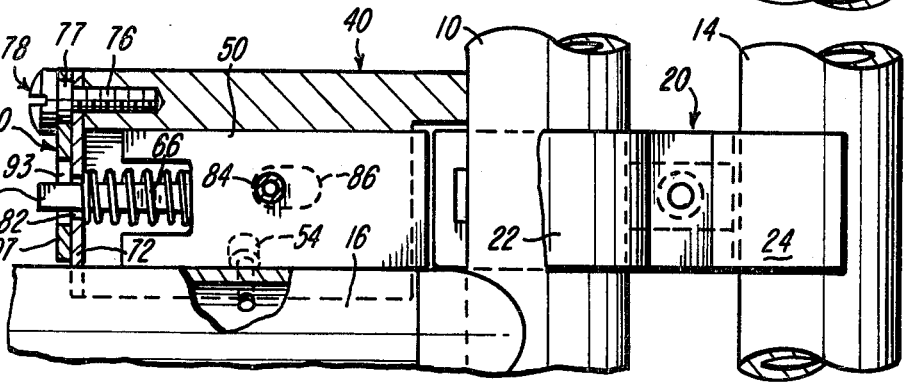
FIG. 5 is a view similar to FIG. 4 with the bolt in unlocked position.

Bolt 50 can be retracted only after the pendulum stop 90 has been swung about shoulder bolt 78 such as, by way of example, is illustrated in FIG. 2 for disposing and aligning one or the other of its intermediate openings 93 or 95 in alignment with opening 82 of the hasp 72, in which position the intermediate openings 93 or 95 will also be disposed in alignment with the rear end 64 of bolt 50, whereby said bolt may be retracted as illustrated in FIG. 5, whereupon the gate may be swung about its axis relative to the vertical member 14 of the fixed gate frame, as in FIG. 7.

When the bolt retracting force has been discontinued spring 66 will normally and yieldably urge forward end 62 of the bolt toward and in contracting relationship with one or the other of the arcuate bearing surfaces 100 or 102 which are disposed between an elevated forward camming surface 104 and a rearward stop-surface 106.

As clearly illustrated in FIG. 7, engagement of the forward end 62 of bolt 50 with a stop 106 of the latch-catch 20 limits the amount by which the latch-catch may be rotated on vertical member 10 of the gate, and thereby position throat 26 whereby to engage the vertical member 14 of the gate frame as the gate is swung or returned from an open position of FIG. 7 to a closed position of FIG. 6.

It will be understood that as vertical member 14 of the gate frame enters throat 24, during a gate-closing operation, the latch-catch 20 will be turned on vertical member 10 of the gate whereby the forward end 62 of the bolt will ride upon one or the other of arcuate surfaces 100–102 and thence on camming surface 104 which causes bolt 50 to be further retracted against the counterforce of spring 66 until such time as the forward end of the bolt clears the cam surface 104 when the bolt is aligned with the bolt-receptive slot 30 of the latch-catch into which slot the forward end of the bolt will be literally driven by spring 66 for thereby locking the gate relative to the gate frame by locking the latch-catch against rotation on vertical member 10.

With reference again to FIG. 7, it will be noted that the rear end 64 of bolt 50 is disposed outwardly beyond the pendulum stop 90, as in FIG. 5, said bolt end projecting through one or the other of the elongate openings 93 and 95 for maintaining said pendulum stop in a non-interfering relationship with respect to the outer end of the bolt. However, when the bolt is advanced into the bolt-receptive slot 30 of the latch-catch, the rear end 64 of the bolt will be advanced through the elongate openings 93 or 95 of the pendulum stop to the position illustrated in FIGS. 4 and 6 thereby permitting the pendulum stop 90 to immediately assume the lowered interfering position of FIGS. 1, 4 and 6 for precluding the accidental or unintentional actuation of bolt 50 from its fully advanced position in locking relationship with the latch-catch.

In the preferred embodiment of the invention, the relationship between the overall travel of bolt 50, as determined by the length of the elongate slots 86 in the bolt housing and the height of the raised forward camming surfaces 104 of the latch-catch are such as to enable the forward end 62 of the bolt to fully engage slot 30 of the latch-catch when the bolt is in a fully advanced, locked position, FIG. 6, and wherein the said forward end 62 will remain in engagement with the raised camming surface portion of said slot until the bolt has been retracted to position Q of FIG. 6 as the result of a deliberate, positive action on the part of an operator, whereby to clear said raised camming surface, at which time pin 84 of the bolt will engage the rear end of slots 86.

As soon as the forward end 62 of the bolt has cleared the raised, forward camming surface 104 of slot 30 of the latch-catch the bolt pin 84 is released from its fully retracted position K, FIG. 6, as the gate is swung to the right or left relative to vertical member 14 of the gate frame, thereby permitting the forward end of the bolt to engage camming surface 100, or 102 during which time the rear end 64 of the bolt will project through one or the other of openings 93–95 of the pendulum stop 90 to hold said stop in the non-interfering relationship illustrated in FIGS. 2 and 5. The pendulum stop will be maintained in a non-interfering relationship with the rear end of the bolt until such time as the bolt is further retracted incident to movement of the forward end 62 back over the raised forward camming surface 104, as the gate is closed, and the bolt is then advanced into slot 30 by spring 66. Then and only then will the pendulum stop be released to gravitate to the fully lowered, interfering relationship of FIGS. 1 and 4 with portions 97 thereof in blocking relationship with respect to opening 82 of the hasp 72 and the rear end 64 of the bolt.

In the event that it should become necessary or desirable to prevent the unauthorized actuation of the locking mechanism the bail portion B′ of a pad-lock P may be introduced through aligned openings 83–93 or 85–95 of the hasp 72 and pendulum stop 90, respectively, for locking the pendulum stop with its solid abutment area 97 in alignment with the rear end 64 of bolt 50.

The pendulum stop 90, and the bolt actuator pin 84 are arranged in such a manner as to permit their sequential manipulation with one hand, and, once the gate has opened, it will be automatically latched in a fully closed position as the forward end 62 of the bolt is positively driven under spring pressure into the latch-receptive slot of the latch-catch, thereby effectively preventing the accidental or unintentional re-opening of the gate.

Since the latch-catch is formed from two mating parts it may be easily associated with the vertical member 14 of a gate adjacent a horizontal gate frame member 16, as illustrated in FIG. 1.

From the foregoing, it will be noted that I have thus provided simple yet highly effective latching means which permits the gate to open "in" or "out", an important capability for the gates of dog kennels, and the like.

What is claimed is:

1. A retractable latch for the latch-catch of a gate, said latch comprising a bolt housing, a bolt mounted within said housing for endwise axial movement between fully advanced and retracted positions, means yieldably urging said bolt to a fully advanced position, a hasp connected to said housing and having a central opening defined therein through which a rear end of said bolt passes when said bolt is in said fully retracted position and a pair of through-openings defined therein; and a pendulum stop pivotally attached to said housing in covering relationship with said hasp so that said hasp is interposed between said pendulum stop and said housing, said pendulum stop having an abutment area adapted to be positioned adjacent said hasp central opening for contacting said bolt rear end and preventing movement of said bolt into said retracted position; said pendulum stop having a pair of elongate openings defined therein adjacent said abutment area, each of said elongate openings being positioned for disposition into alignment with said hasp central opening by pivotal movement of said pendulum stop so that said bolt rear end can pass through said aligned central and elongate openings to permit movement of said bolt into said fully retracted position, and pendulum stop being pivotally connected to said housing to assume a position with said abutment area aligned with said hasp central opening under the influence of gravity to be in an interfering relationship with said bolt unless moved to align one of said elongate openings with said hasp central opening thereby preventing the unintentional or accidental retraction of the bolt from a fully advanced position; said hasp through openings each being aligned with one of said pendulum stop elongate openings to receive a locking means when said pendulum stop is in said interfering relationship so that said latch bolt can be locked in said fully advanced position.

2. A latch as called for in claim 1, wherein the bolt housing and bolt each include forward and rear ends, and wherein the forward and rear ends of the bolt project beyond corresponding ends of said housing when the bolt is in fully advanced and retracted positions.

3. A latch as called for in claim 2, wherein the pendulum stop is pivotally secured to the rear end of the housing .

4. A latch as called for in claim 3, wherein the housing is substantially U-shaped providing an elongate channel in which the bolt is slideably mounted, said housing having a pair of transversely aligned, elongate, horizontal slots therein on opposite sides of the channel, a bolt actuator secured to, carried by, and projecting transversely from said bolt and projecting through and beyond said slots, wherein the length of said slots determines the overall endwise axial movement of the bolt between its fully advanced and retracted positions.

5. A latch as called for in claim 3, wherein the pendulum stop is gravitationally urged to a position of interfering relationship relative to the rear end of the bolt, when the bolt is in a fully advanced position.

6. A latch as called for in claim 5, wherein the pendulum stop when disposed in a position of interfering relationship with respect to the end of the bolt, engages a side of that portion of the bolt which projects outwardly beyond the rear end of the housing, when the bolt is retracted from a fully advanced position.

7. A latch as called for in claim 6, wherein the pendulum stop is maintained in a position of noninterfering relationship with respect to the rear end of the bolt until such time as the bolt is moved to its fully advanced position, at which time said pendulum stop will gravitate to a position of interfering relationship with respect to the rear end of the bolt.

8. A latch as called for in claim 4, wherein said hasp is fixedly secured to the rear end of the housing , said hasp through and said pendulum stop openings dimensioned to receive the bail of a padlock for securely, though releasably locating said pendulum stop in a position of interfering relationship with the rear end of the bolt.

9. A latch as called for in claim 8, which includes a spring disposed in circumscribing relationship with the bolt between the hasp and a portion of the bolt spaced forwardly from the rear end thereof, said spring normally and yieldably urging said bolt toward a fully advanced position.

10. A latch as called for in claim 3, wherein the latch-catch includes one end which terminates in an open, outwardly extending, substantially U-shaped throat, and an opposite axially aligned other end which terminates in a closed cylindrical portion dimensioned to pivotally engage the outer cylindrical surface of the vertical member of the outer end of a swing gate, said cylindrical portion having a recess therein to receive the forward end of the latch bolt when in a fully advanced position for precluding rotation of the latch-catch relative to said vertical member.

11. A latch as called for in claim 10, wherein the latch bolt, when the forward end thereof is received in the recess of the latch-catch, is secured against accidental or unintentional withdrawal therefrom during those periods of time when the pendulum stop is in a position of interfering relationship with respect to the rear end of the bolt.

12. A latch as called for in claim 11, wherein the outer surface of the cylindrical portion of the latch-catch on opposite sides of the bolt-receptive recess defines a cam surface, one or the other of which cam surfaces are engaged by the forward end of the bolt when the bolt has been retracted from said recess and the latch-catch rotated relative to said bolt.

13. A latch as called for in claim 12, wherein each cam surface includes an elevated portion adjacent the recess, an intermediate radial portion of lesser height than said elevated portion, and an abutment portion remote from the recess, said abutment portion limiting the amount by which the latch-catch may be rotated relative to the bolt.

14. A latch as called for in claim 13, wherein the relationship of the elevated and radial cam surfaces to the pendulum stop are such that, upon movement of said stop to a noninterfering position with respect to the rear end of the bolt and retraction of the bolt from its fully advanced position, a side of the pendulum stop engages a side of the rear end adjacent portion of the bolt for maintaining said pendulum stop in an elevated noninterfering position with respect to the rear end of the bolt permitting the latch-catch to rotate on said vertical member.

15. A latch as called for in claim 14, wherein the forward end of the bolt when retracted from the recess of the latch-catch rides upon one or the other of the cam surfaces between said recess and the abutment portion of said cam surface incident to rotation of the latch-catch on said vertical member.

16. A latch as called for in claim 10, wherein the latch-catch comprises two complimentary halves, and means interconnecting said halves for pivotally mounting said latch-catch to the vertical member of a swing gate.

17. A gate latch which comprises a latch and a latch-catch; one end of said latch-catch terminating in an open, outwardly extending, substantially U-shaped throat, and an opposite axially aligned other end which terminates in a closed cylindrical portion dimensioned to pivotally engage the outer cylindrical surface of the vertical member of the outer end of a swing gate; said cylindrical portion having a recess therein to receive the forward end of the latch; said latch including a bolt housing and a bolt mounted within said housing for endwise movement relative to the cylindrical portion of the latch-catch between fully advanced and retracted positions, said bolt including a forward end receivable within the recess of the latch-catch for precluding rotation of the latch-catch on said vertical member; means yieldably advancing said bolt toward said latch-catch; and means precluding the accidental or unintentional retraction of the bolt from a fully advanced position relative to the latch-catch; said last mentioned means manually movable for permitting retraction of said bolt from a fully advanced position incident to withdrawal of the forward end of the bolt from the recess of said latch-catch and including a hasp connected to said housing and having an aperture defined therein through which a rear end of said bolt passes when said bolt is in said fully retracted position and a through-opening defined therein; and a pendulum stop pivotally attached to said housing in covering relationship with said hasp so that said hasp is interposed between said pendulum stop and said housing, said pendulum stop having an abutment area adapted to be positioned adjacent said hasp aperture for contacting said bolt rear end and preventing movement of said bolt into said retracted position; said pendulum stop having an opening defined therein adjacent said abutment area and being positioned for disposition into alignment with said hasp aperture by pivotal movement of said pendulum stop so that said bolt rear end can pass through said aligned hasp aperture and pendulum opening to permit movement of said bolt into said fully retracted position, said pendulum stop being pivotally connected to said housing to assume a position with said abutment area aligned with said hasp aperture under the influence of gravity to be in an interfering relationship with said bolt unless moved to align said pendulum stop opening with said hasp aperture thereby preventing the unintentional or accidental retraction of the bolt from a fully advanced position; said hasp through opening being aligned with said pendulum stop opening to receive a locking means when said pendulum stop is in said interfering relationship so that said latch bolt can be locked in said fully advanced position; camming surfaces on the outer surface of the latch-catch on opposite sides of the recess therein, said camming surfaces engagable by the forward end of the bolt during those periods of time when the bolt is retracted from said recess and the latch-catch rotated on the said vertical member.

18. A fool-proof gate latch for the vertical member which defines the outermost swinging edge of a gate which is adapted to be swung between open and closed positions relative to the vertical member of a gate frame wherein the vertical members are disposed in parallel juxtaposition and the latch engages the vertical member of the gate frame when the gate is closed comprising:

(a) a latch-catch having one end which terminates in an open, outwardly extending, substantially U-shaped throat and an opposite, axially aligned other end which terminates in a closed cylindrical portion engaged to pivotally engage the outer cylindrical surface of the vertical member of the gate frame, and wherein the U-shaped throat is dimensioned to engage the vertical member of the gate when the gate is closed, and wherein movement of said gate from a closed to an open position causes the latch-catch to be turned upon the vertical member of the gate frame as the throat is disengaged from the vertical member of the gate frame;

(b) an elongate bolt having front and rear ends;

(c) means mounting said bolt for endwise movement between advanced and retracted positions relative to the cylindrical portion of said latch-catch;

(d) a bolt-receptive recess in the cylindrical portion of said latch-catch;

(e) said latch-catch having a camming surface on each side of such recess;

(f) means normally and yieldably moving such bolt to an advanced position;

(g) a gravitational pendulum stop movable between interfering and noninterfering relationship with the rear end of said bolt;

(h) said pendulum stop when in interfering relationship with the rear end of said bolt precluding the accidental or unintentional retraction of the bolt from a fully advanced position within the recess of the latch-catch;

(i) said pendulum stop being manually shiftable from interfering to noninterfering relationship with the rear end of said bolt for enabling said bolt to be retracted from its fully advanced position against the counterforce of the said means normally and yieldably urging said bolt to an advanced position thereby releasing the latch-catch for pivotal movement on the said vertical member of the gate.

19. A fool-proof latch as called for in claim 18, wherein the forward end of the bolt is adapted to ride upon the camming surfaces of the latch-catch, on one side or the other of the recess, during those periods of time when the latch member is free to rotate on the said vertical member of the gate; said camming surfaces including an abutment remote from the recess; said abutments engaged by the forward end of the bolt for limiting rotation of the latch-catch; and means engagable with said pendulum stop for securely, though releaseably, anchoring it in interfering relationship with the rear end of the bolt.

20. A retractable latch for the latch-catch of a gate, said latch comprising a bolt housing, a bolt mounted within said housing for endwise axial movement between fully advanced and retracted positions, means yieldably urging said bolt to a fully advanced position, a hasp connected to said housing and having an aperture defined therein through which a rear end of said bolt passes when said bolt is in said fully retracted position and a through-opening defined therein; and a pendulum stop pivotally attached to said housing in covering relationship with said hasp so that said hasp is interposed between said pendulum stop and said housing, said pendulum stop having an abutment area adapted to be positioned adjacent said hasp aperture for contacting said bolt rear end and preventing movement of said bolt into said retracted position; said pendulum stop having an opening defined therein adjacent said abutment area and being positioned for disposition into alignment with said hasp aperture by pivotal movement of said pendulum stop so that said bolt rear end can pass through said aligned hasp aperture and pendulum opening to permit movement of said bolt into said fully retracted position, said pendulum stop being pivotally connected to said housing to assume a position with said abutment area aligned with said hasp aperture under the influence of gravity to be in an interfering relationship with said bolt unless moved to align said pendulum stop opening with said hasp aperture thereby preventing the unintentional or accidental retraction of the bolt from a fully advanced position; said hasp through opening being aligned with said pendulum stop opening to receive a locking means when said pendulum stop is in said interfering relationship so that said latch bolt can be locked in said fully advanced position.

* * * * *